United States Patent [19]

Conley

[11] Patent Number: 5,049,896

[45] Date of Patent: Sep. 17, 1991

[54] ANTENNA MOUNT

[76] Inventor: James B. Conley, P.O. Box 645, Fenton, Mo. 63026

[21] Appl. No.: 515,241

[22] Filed: Apr. 27, 1990

[51] Int. Cl.[5] ..... H01Q 1/12

[52] U.S. Cl. ..... 343/888; 343/709; 343/906

[58] Field of Search ..... 343/888, 890, 892, 880, 343/709, 711, 713, 878, 906; 248/177, 178, 200.1

[56] References Cited

U.S. PATENT DOCUMENTS

| | | | |
|---|---|---|---|
| 1,761,608 | 6/1930 | Agner . | |
| 2,336,104 | 12/1943 | Laube et al. | 248/178 |
| 2,684,399 | 7/1954 | Shanks | 174/137 |
| 3,461,455 | 8/1969 | Rowe | 343/888 |
| 3,899,787 | 8/1975 | Czerwinkski | 343/790 |
| 4,066,324 | 1/1978 | Stephens | 339/126 |
| 4,152,704 | 5/1979 | Burg | 343/709 |
| 4,329,690 | 5/1982 | Parker | 343/709 |
| 4,368,940 | 1/1983 | Sugiura | 339/177 |
| 4,491,849 | 1/1985 | Tilston et al. | 343/791 |

*Primary Examiner*—Michael C. Wimer
*Assistant Examiner*—Hoanganh Le
*Attorney, Agent, or Firm*—Senniger, Powers, Leavitt & Roedel

[57] ABSTRACT

An apparatus for mounting an antenna at the upper end of a mast. The antenna has a first electrical connector extending downward from its lower end. The mast has a second electrical connector extending upward from its upper end and is interengageable with the first connector. The apparatus comprises a head moveably adjustable on the upper end of the mast. The head has a skirt surrounding the mast and an upper surface. The upper surface has an opening therein dimensioned for passage of the connectors. The head is movable downwardly on the upper end of the mast to a lowered retracted position and movable upwardly on the upper end of the mast to a raised extended position. When the head is in its retracted position the second connector extends up through the opening above the upper surface for connection of the connectors. When the head is in its extended position the lower end of the first connector extends down through the opening and the head is in abutting relationship with the lower end of the antenna around the second connector. The apparatus further includes a mechanism for securing the head in its raised extended position to the mast.

15 Claims, 2 Drawing Sheets

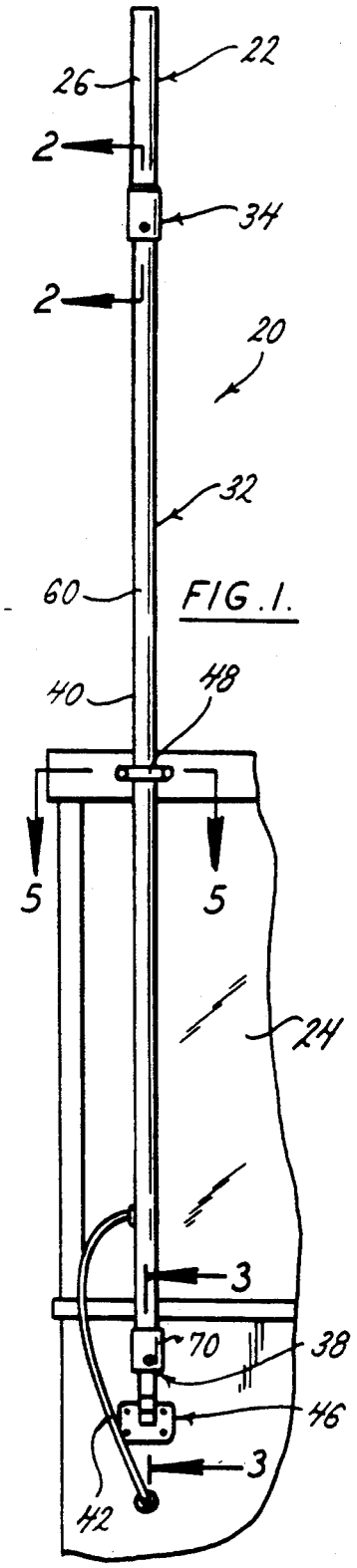
FIG. 1.
FIG. 2.
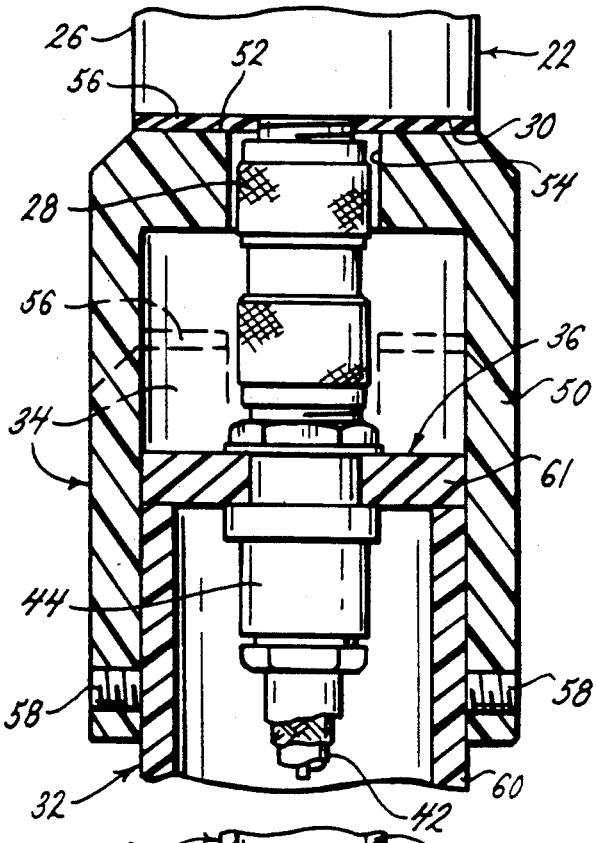
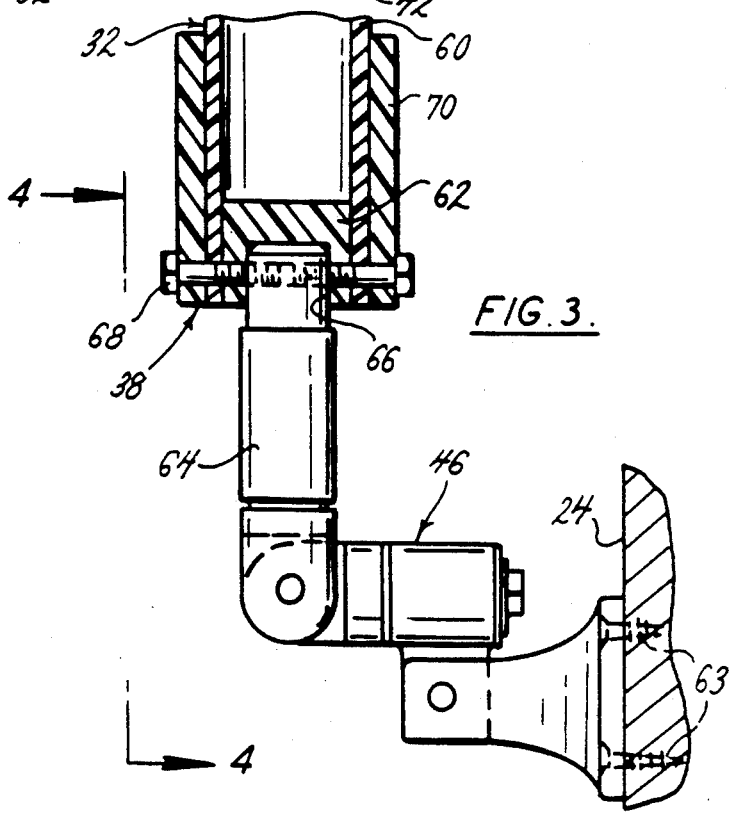
FIG. 3.

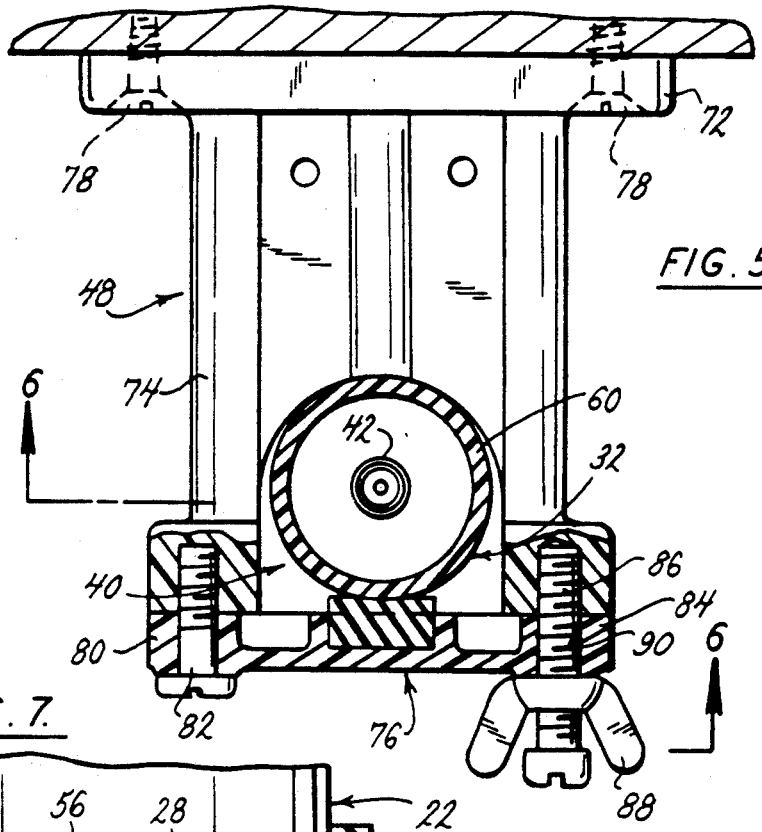
FIG. 5.
FIG. 7.
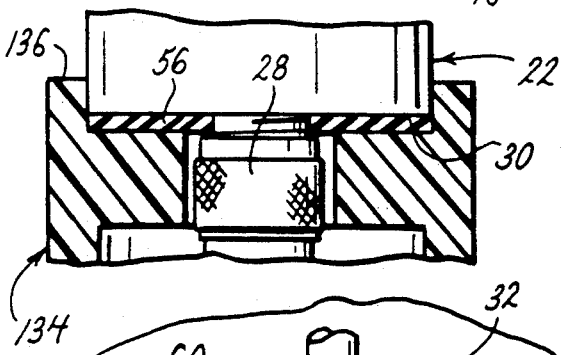
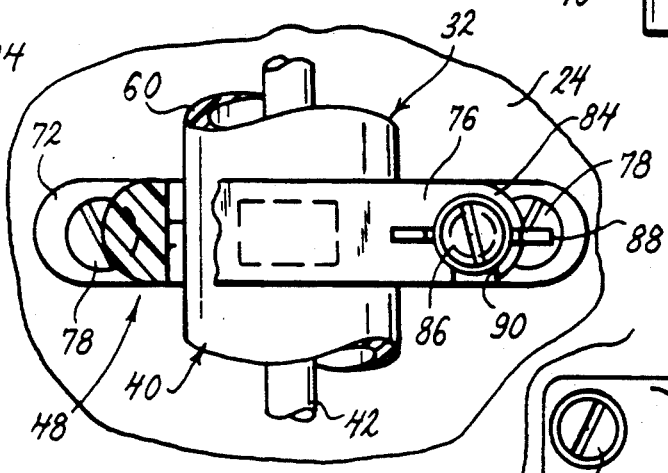
FIG. 6.
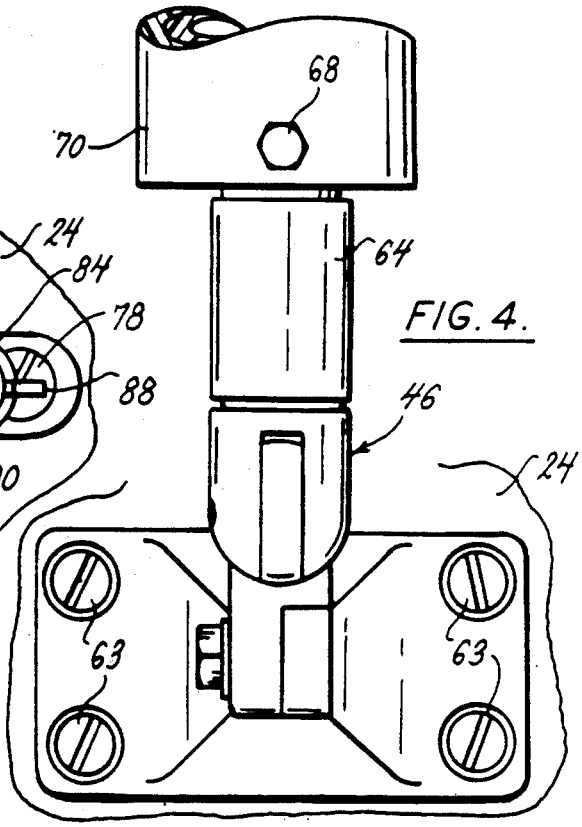
FIG. 4.

ANTENNA MOUNT

BACKGROUND OF THE INVENTION

This invention relates generally to antenna mounts, and in particular to a mount for securing a portable antenna to the top of a mast.

Global Positioning System (GPS) is a space-based positioning and velocity system for determining the worldwide position and velocity of a craft, such as a wheeled or tracked vehicle, an amphibian, or watercraft. GPS has three major segments: space (transmitting satellites), control, and user equipment (receiver). The GPS is predicated upon accurate and continuous knowledge of the spatial position of each satellite in the system, with respect to time and distance from a transmitting satellite to the user. Each satellite transmits its unique ephemeris data. This data is periodically updated by a master control station based upon information obtained from widely dispersed monitor stations. The GPS receiver automatically selects appropriate signals from the three or four satellites best in view based on optimum satellite-to-user geometry. It then solves time of arrival difference quantities to obtain the distance between user and satellites. This information establishes the user position with respect to the satellite system. A time correction factor then relates the satellite system to earth coordinates. The user equipment measures four independent pseudo ranges and range rates and translates these to three-dimensional position and velocity.

The receiver includes a standardized antenna mounted on the craft. The GPS antenna has a smooth generally cylindrical body and a coaxial electrical connector extending downward from its lower end which engages with a connector on a cable leading to the receiver. The GPS antenna may be mounted on a mast secured to the craft. The antenna may be susceptible to damage by excessive vibration to the craft or by impact to the antenna by, for example, tree branches. GPS antenna have often been supported only by the connection of the connectors. A problem associated with supporting a GPS antenna only by its connector is that the connector is likely to break if the craft is excessively shocked or vibrated or if the antenna is struck by an object or impacted by a sudden gust of wind. Such breakage renders the system inoperable. Also, replacement GPS antenna are expensive.

SUMMARY OF THE INVENTION

Among the objects of the present invention may be noted the provision of an antenna mount for mounting an antenna to the upper end of a mast; the provision of such a mount which resists breakage of the antenna connector; a mount which accommodates rapid attachment of the antenna to the mast and rapid removal of the antenna from the mast; the provision of such a mount which has a relatively simple construction and has few moving parts.

Generally, the apparatus of the present invention is an antenna mount for mounting an antenna on the upper end of a mast. The antenna has a first electrical connector extending downward from its lower end. The mast has a second electrical connector extending upward from its upper end and interengageable with the first connector. The mount comprises a head moveably adjustable on the upper end of the mast. The head has a skirt surrounding the mast and an upper surface. The upper surface has an opening therein dimensioned for passage of the connectors. The head is movable downwardly on the upper end of the mast to a lowered retracted position and movable upwardly on the upper end of the mast to a raised extended position. When the head is in its retracted position the second connector extends up through the opening above the upper surface for connection of the connectors. When the head is in its extended position the lower end of the first connector extends down through the opening and the head is in abutting relationship with the lower end of the antenna around the second connector. The mount further comprises a mechanism for securing the head in its raised extended position to the mast.

Because the antenna is secured by the connectors and the interengaging of the head to the antenna, the antenna can be quickly mounted on the mast simply by interengaging the connectors and then moving the head upward to its raised extended position. Likewise, the antenna can be quickly removed from the mast by moving the head downward to its retracted position and disengaging the connectors. Because the antenna is supported by the head in addition to the connectors, likelihood of connector breakage is reduced.

These and other advantages will be in part apparent and in part pointed out hereinafter.

BRIEF DESCRIPTION OF THE DRAWINGS

FIG. 1 is a front elevational view of an antenna secured to a craft by an antenna mount of the present invention;

FIG. 2 is an enlarged cross-sectional view taken along line 2—2 of FIG. 1 showing the head and connectors for securing the antenna to the top of the mast;

FIG. 3 is an enlarged side elevational view, in partial section, taken along line 3—3 of FIG. 2 showing the connector for securing the bottom end of the mast to the craft;

FIG. 4 is a front elevational view taken along line 4—4 of FIG. 3 showing the connector of FIG. 3;

FIG. 5 is a top plan view taken along line 5—5 of FIG. 1 showing the bracket for securing an intermediate portion of the mast to the craft;

FIG. 6 is a side elevational view, in partial section, taken along line 6—6 of FIG. 5 showing the bracket of FIG. 5; and FIG. 7 is front elevational view, in partial section, showing another embodiment of a head for securing the antenna to the top of the mast.

Corresponding reference numerals indicate corresponding parts throughout the several views of the drawings.

DETAILED DESCRIPTION OF THE PREFERRED EMBODIMENTS

An antenna mount constructed according to the principles of this invention is indicated generally as 20 in FIG. 1. The mount 20 secures an antenna 22, such as a GPS antenna, to a military craft 24, such as a wheeled or tracked vehicle, an amphibian, or watercraft. The antenna 22 receives signals from the transmitting satellites and communicates with the receiver for determining the position of the craft. As shown in FIGS. 1 and 2, the antenna 22 has an elongate body 26 and a first coaxial electrical cable connector 28 extending downward from the lower end 30 of the antenna 22. The mount 20 comprises an elongate mast 32 and a head 34 moveably adjustable on the mast 32. The mast 32 includes an upper end 36, a lower end 38, an intermediate portion 40, a coaxial cable 42 extending through the mast 32 and connected to the receiver (not shown), and a second coaxial electrical cable connector 44 having one end connected to the coaxial cable 42 and its other end extending upwardly from the upper end 36 and interengageable with the first connector 28. A pedestal 46 secures the lower end 38 of the mast to the craft 24. A bracket 48 secures the intermediate portion 40 of the mast 32. The pedestal 46 and bracket 48 constitute means for securing the mast to the craft. The connectors 28 and 44 are preferably N-type connectors and have screw threads to enable them to be screwed together. The head 34 is slidably adjustable on the upper end 36 of the mast 32 and interengages and supports the lower end 30 of the antenna 22.

The head 34 has a skirt 50 surrounding the mast 32 and an upper surface 52. The upper surface 52 has an opening (port) 54 therein dimensioned for passage of the connectors 28 and 44. The head 34 is slidable downward on the upper end 36 of the mast 32 to a lowered retracted position (shown in phantom in FIG. 2) and slidable upward on the mast 32 to a raised extended position (shown in solid in FIG. 2). When the head 34 is in its retracted position, the second connector 44 extends up through the opening 54 above the upper surface 52 for connection of the connectors 28 and 44. When the head 34 is in its extended position, the first connector 28 extends down through the opening 54 and the head 34 is in abutting relationship with the lower end 30 of the antenna 22 around the second connector 44. The head 34 includes a seal member 56 at its upper end to seal against moisture leakage between the head 34 and antenna 22. Setscrews 58, extending through the skirt, are engageable with the upper end 36 of the mast 32 to lock the head 34 to the mast 32. The setscrews 58 constitute means for securing the head 34 in its raised extended position to the mast 32. Preferably, when the head 34 is locked in its extended position, the connectors 28 and 44 are at least slightly tensioned to ensure that the lower end 30 of the antenna 22 and the head 34 remain in contact.

The mast 32 has an elongate tubular body 60 made of a strong, lightweight material, such as PVC. A disc 61 (see FIG. 2), fixed to its upper end 36, supports the second connector 44. A plug 62 (see FIG. 3), inserted in its lower end 38, interengages the pedestal 46. As shown in FIGS. 3 and 4, the pedestal 46 is a swivel mount connector mounted to the vessel by a plurality of screws 63 and having an upwardly extending stem 64. The plug 62 includes an upwardly extending bore 66 dimensioned for receiving the stem 64. Screws 68, extending through the lower end 38 of the mast 32, engage the stem 64 to secure the stem 64 in the bore 66. A sleeve (ferrule) 70 is positioned around the lower end of the body 60 to strengthen the lower end 38 of the mast 32. Thus, the pedestal 46 secures the lower end 38 of the mast 32 to the craft 24.

As shown in FIGS. 5 and 6, the intermediate portion 40 of the mast 32 is secured to the craft 24 by the bracket 48. The bracket 48 is a quick release bracket and includes a base portion 72, a body portion 74, and a swing arm 76. The base portion 72 is fixed to the craft 24 by a plurality of screws 78. The swing arm 76 has a first end 80 pivotally connected to the body portion 74 by a pin 82 and a second end 84 adapted to be locked to the body portion 74 by a bolt 86 and wing nut 88. The tip of the bolt 86 extends into the body portion 74 and the wing nut 88 is threaded on the body of the bolt 86. The second end 84 has a recess 90 for engaging the body of the bolt 86. When the recess 90 engages the body of the bolt 86, the second end 84 is locked to the body portion 74 by the wing nut 88. The arm 76 is movable from a closed position to an open position. In the closed position the intermediate portion 40 of the mast 32 is secured between the arm 76 and body portion 74 and the second end is locked to the bolt 86. In the open position the second end 84 is pivoted away from the body portion 74 so that the mast 32 can be removed from the bracket 48.

In operation, the antenna 22 can be quickly mounted on and removed from the mast 32, and the mast can be quickly secured to and removed from the craft 24. The head 34 is lowered to its retracted position and the first connector 28 is threaded to the second connector 44. The head 34 is then slid upward to its extended position so that the seal member 56 pushes against the lower end 30 of the antenna 22 to slightly tension the connectors 28 and 44. The setscrews 58 are then tightened to lock the head 34 in its extended position. The antenna 22 is removed from the mast 32 by loosening the setscrews 58, lowering the head 34 to its retracted position, and then unscrewing the first connector 28 from the second connector 44. Thus, the antenna 22 can be quickly mounted to and removed from the mast 32. Because the antenna 22 is supported by the head 34 in addition to the connectors, likelihood of connector breakage is reduced.

The mast 32 is quickly secured to the craft 24 by the pedestal 46 and bracket 48. The plug 62 is positioned on the stem 64 and secured in position by the screws 68. The intermediate portion 40 of the mast 32 is then inserted into the open bracket 48 and the bracket 48 is then closed by swinging the arm 76 to its closed position and tightening the wing nut 88. Likewise, the mast 32 is quickly disconnected from the craft 24 by opening the bracket 48, removing the screws 68 from the stem 64 and then lifting the mast 32 off of the stem 64 and away from the bracket 48. Thus, the pedestal 46 and bracket 48 constitute means for releasably securing the mast 32 to the craft 24.

FIG. 7 shows a second embodiment of a head designated generally as 134. The head 134 is similar to the head 34 of FIG. 2 except the head 134 includes a lip 136 around its upper surface. The lip 136 extends up beyond and surrounds the lower end 30 of the antenna 22 when the head 134 is in its raised extended position so that the head 134 interengages the lower end 30 and holds it in position.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for mounting an antenna at an upper end of a mast, the antenna having a lower end and a first electrical connector extending forward from its lower end, the mast having a second electrical connector extending upward from its upper and interchangeable with the first connector, the apparatus comprising:

a head moveably adjustable on the upper end of the mast, the head having a skirt surrounding the mast and an upper surface, the upper surface having an opening therein dimensioned for passage of the connectors, the head being movable downwardly on the upper end of the mast to a lowered retracted position and movable upwardly on the upper end of the mast to a raised extended position, when the head is in its retracted position the second connector extends up through the opening above the upper surface for connection of the connectors, when the head is in its extended position the lower end of the first connector extends down through the opening and the upper surface of the head is in abutting relationship with the lower end of the antenna and the skirt surrounds the second connector; and means for securing the head in its said raised extended position to the mast.

2. The apparatus of claim 1 wherein the head is slidably moveable on the upper end of the mast.

3. The apparatus of claim 2 wherein the head further comprises a seal at its upper end for sealing against moisture leakage between the head and antenna when the head is in its said raised extended position.

4. The apparatus of claim 2 wherein the head further includes a lip around the upper surface, the lip extending up beyond and surrounding the lower end of the antenna when the head is in its said raised extended position.

5. The apparatus of claim 2 wherein the head securing means comprises at least one setscrew extending through the skirt and engageable with the mast.

6. The apparatus of claim 1 wherein when the head is in its extended position the connectors are tensioned.

7. Apparatus for releasably mounting an antenna to a craft, the antenna having a lower end and a first electrical connector extending downwardly from its lower end, said apparatus comprising:

a mast having an upper end and a second electrical connector extending upwardly from its upper end and interengageable with the first connector;

means for securing the mast to the craft;

a head moveably adjustable on the upper end of the mast having a skirt surrounding the mast and an upper surface, the upper surface having an opening therein dimensioned for passage of the connectors, the head being movable downwardly on the upper end of the mast to a lowered retracted position wherein the second connector extends up through the opening above the upper surface for connection of the connectors, the head then being movable upwardly on the upper end of the mast to a raised extended position wherein the upper surface of the head is in abutting relationship with the lower end of the antenna and the skirt surrounds the second connector, at least a portion of the first connector then extending down through the opening; and means for securing the head in its said raised extended position to the mast.

8. The apparatus of claim 7 wherein the head is slidably moveable on the upper end of the mast.

9. The apparatus of claim 7 wherein the head further comprises a seal at its upper end for sealing against moisture leakage between the head and antenna when the head is in its said raised extended position.

10. The apparatus of claim 7 wherein the head further includes a lip around the upper surface, the lip extending up beyond and surrounding the lower end of the antenna when the head is in its said raised extended position.

11. The apparatus of claim 7 wherein the head securing means comprises at least one setscrew extending through the skirt and engageable with the mast.

12. The apparatus of claim 7 wherein said mast securing means comprises means for releasably securing the mast to the craft.

13. The apparatus of claim 12 wherein the lower end of the mast includes an upwardly extending bore, said means for releasably securing the mast comprising a stem mountable on the craft and extending up into the bore, so that the mast sits on and is supported by the stem.

14. The apparatus of claim 13 wherein said means for releasably securing the mast further comprises a bracket mountable on the craft for engaging an intermediate portion of the mast.

15. The apparatus of claim 7 wherein when the head is in its extended position the connectors are tensioned.

* * * * *

UNITED STATES PATENT AND TRADEMARK OFFICE

CERTIFICATE OF CORRECTION

PATENT NO. : 5,049,896

DATED : September 17, 1991

INVENTOR(S) : James B. Conley

It is certified that error appears in the above-identified patent and that said Letters Patent is hereby corrected as shown below:

Column 4, claim 1, line 65, "extending forward" should read ---extending downward---.

Column 4, claim 1, line 67, "upper and" should read ---upper end and---.

Column 4, claim 1, line 67, "interchangeable" should read ---interengageable---.

Signed and Sealed this

Twenty-third Day of March, 1993

*Attest:*

STEPHEN G. KUNIN

*Attesting Officer*

*Acting Commissioner of Patents and Trademarks*